US008430137B2

(12) United States Patent
Sim

(10) Patent No.: US 8,430,137 B2
(45) Date of Patent: Apr. 30, 2013

(54) REFILL CAP CARTRIDGE

(76) Inventor: Jae K. Sim, Rancho Cucamonga, CA (US)

( * ) Notice: Subject to any disclaimer, the term of this patent is extended or adjusted under 35 U.S.C. 154(b) by 0 days.

(21) Appl. No.: 13/216,945

(22) Filed: Aug. 24, 2011

(65) Prior Publication Data

US 2012/0048421 A1 Mar. 1, 2012

Related U.S. Application Data

(60) Provisional application No. 61/376,598, filed on Aug. 24, 2010.

(51) Int. Cl.
*B65B 1/04* (2006.01)
*B67B 7/06* (2006.01)

(52) U.S. Cl.
USPC ..... 141/322; 141/112; 141/301; 206/219; 206/222

(58) Field of Classification Search ..... 141/2, 18, 141/22, 100, 112, 113, 322, 301, 381; 222/510, 222/129, 82; 206/219, 222
See application file for complete search history.

(56) References Cited

U.S. PATENT DOCUMENTS

| | | | | |
|---|---|---|---|---|
| 538,561 | A * | 4/1895 | Upton | 222/510 |
| 1,449,571 | A * | 3/1923 | Younger | 222/246 |
| 1,902,157 | A * | 3/1933 | Blomstrom | 222/44 |
| 2,189,238 | A * | 2/1940 | Benjamin | 73/864.63 |
| 2,642,065 | A | 4/1951 | Negri | |
| 3,024,947 | A | 3/1962 | Jeynes, Jr. et al. | |
| 3,080,094 | A | 3/1963 | Modderno | |
| 3,134,505 | A | 5/1964 | Modderno | |
| 3,172,568 | A | 3/1965 | Modderno | |
| 3,221,946 | A | 12/1965 | Riley | |
| 3,240,391 | A | 3/1966 | Garton | |
| 3,240,403 | A | 3/1966 | Modderno | |
| 3,255,924 | A | 6/1966 | Modderno | |
| 3,255,926 | A | 6/1966 | Modderno | |
| 3,314,563 | A | 4/1967 | Mounier | |
| 3,318,484 | A | 5/1967 | Modderno | |
| 3,458,076 | A | 7/1969 | Babcock | |
| 3,548,562 | A | 12/1970 | Schwattzman | |
| 3,613,955 | A | 10/1971 | Wetherell, Jr. | |
| 3,648,899 | A | 3/1972 | Lukesch et al. | |
| 3,655,096 | A | 4/1972 | Easter | |
| 3,891,125 | A | 6/1975 | Morane et al. | |

(Continued)

FOREIGN PATENT DOCUMENTS

| | | |
|---|---|---|
| DE | 8101400 | 5/1981 |
| DE | 3535986 | 4/1987 |

(Continued)

*Primary Examiner* — Timothy L Maust
*Assistant Examiner* — Timothy Kelly
(74) *Attorney, Agent, or Firm* — Stetina Brunda Garred & Brucker

(57) ABSTRACT

Provided is a refill cap cartridge engageable with a bottle during usage thereof. The refill cartridge includes an upper body and a lower body defining a cartridge reservoir. The upper body is configured to be engageable with the body, while the lower body is configured to be insertable within the bottle opening. The refill cartridge additionally includes a plug having an upper plug portion defining an upper plug head and a lower plug portion defining a flared end portion. The plug is engageable with the cap and is moveable relative to the cap between a sealing position and a dispensing position.

17 Claims, 3 Drawing Sheets

U.S. PATENT DOCUMENTS

| | | | | |
|---|---|---|---|---|
| 4,221,291 | A | 9/1980 | Hunt | |
| 4,613,061 | A | 9/1986 | Meuresch et al. | |
| 4,705,191 | A | 11/1987 | Itzel et al. | |
| 4,757,916 | A | 7/1988 | Goncalves | |
| 4,950,237 | A | 8/1990 | Henault et al. | |
| 5,246,142 | A | 9/1993 | Di Palma et al. | |
| 5,273,189 | A | 12/1993 | Jouillat et al. | |
| 5,348,060 | A | 9/1994 | Futagawa et al. | |
| 5,421,483 | A | 6/1995 | Parise | |
| 5,875,888 | A | 3/1999 | Albisetti | |
| 5,927,549 | A | 7/1999 | Wood | |
| 5,944,223 | A | 8/1999 | Klima et al. | |
| 5,957,335 | A | 9/1999 | Otto | |
| 5,992,693 | A | 11/1999 | Albisetti | |
| 6,041,969 | A | 3/2000 | Parise | |
| 6,053,371 | A | 4/2000 | Durliat et al. | |
| 6,152,326 | A | 11/2000 | Klima, Jr. et al. | |
| 6,182,865 | B1 | 2/2001 | Bunschoten et al. | |
| 6,290,100 | B1 | 9/2001 | Yacko et al. | |
| 7,568,576 | B2 * | 8/2009 | Sweeney et al. | 206/219 |
| 7,874,420 | B2 * | 1/2011 | Coon | 206/219 |
| 8,157,131 | B2 * | 4/2012 | Sim | 222/129 |
| 8,261,943 | B2 * | 9/2012 | Sim | 222/129 |
| 8,267,281 | B2 * | 9/2012 | Sim | 222/129 |
| 8,302,816 | B2 * | 11/2012 | Sim | 222/129 |
| 2008/0093381 | A1 * | 4/2008 | Smith et al. | 222/129 |
| 2012/0060968 | A1 * | 3/2012 | Geerse et al. | 141/2 |

FOREIGN PATENT DOCUMENTS

| | | |
|---|---|---|
| EP | 101594 | 2/1984 |
| EP | 173547 | 3/1986 |
| EP | 333541 | 9/1989 |
| EP | 341115 | 11/1989 |
| FR | 2239390 | 2/1975 |
| GB | 2220930 | 1/1990 |
| IT | 1188018 | 12/1987 |

* cited by examiner

REFILL CAP CARTRIDGE

CROSS-REFERENCE TO RELATED APPLICATIONS

This application claims the benefit of U.S. Provisional Application No. 61/376,598, filed Aug. 24, 2010.

STATEMENT RE: FEDERALLY SPONSORED RESEARCH/DEVELOPMENT (Not Applicable)

BACKGROUND OF THE INVENTION

1. Field of the Invention

The present invention relates generally to a refill cartridge for a chemical dispensing bottle, and more particularly to an easy to use refill cartridge integrated into the bottle cap.

2. Description of the Related Art

It is well known in the art to employ the use of a bottle to store and dispense a fluid. For instance, cleaners, cosmetics, and other fluids are commonly sold in bottles, which include an opening, spout or pumping mechanism to facilitate dispensing by a user. After repeated use of the bottle, the amount of liquid in the bottle decreases to the point where the bottle is effectively empty.

Once the bottle is empty, many users are inclined to throw the empty bottle away and purchase a new bottle, despite the fact that the empty bottle is still capable of storing and dispensing fluid. Given that a typical bottle is generally designed to hold a small amount of fluid (i.e., one quart) or a large bulk amount of fluid, a user may quickly consume all of the fluid contained within the bottle. As such, a large number of bottles may be used over a short period of time. Furthermore, many bottles are formed out of environmentally harmful materials, such as plastics. Therefore, large consumption of such bottles may have detrimental effects on the environment.

As an alternative to buying a new bottle upon emptying a previous bottle, a user can oftentimes purchase a refill which usually contains a smaller amount of the fluid in a higher concentration. The fluid in the refill can be poured into the bottle and mixed with water or other diluting fluids to fill the bottle. Purchasing a refill tends to be more environmentally friendly, as the refill container is typically smaller than the original bottle container. Furthermore, the refill tends to be less expensive than purchasing a new bottle because the refill container is generally smaller than the original bottle.

Although purchasing a refill offers certain advantages, many consumers are more likely to purchase a brand new bottle rather than purchase a refill. In this manner, many consumers have a habit of throwing away a bottle when it is empty rather than storing an empty bottle until they can buy a refill. Once the consumer throws the empty bottle away, there are precluded from purchasing a refill. In addition, when refills are sold on a shelf next to a full bottle, consumers may be inclined to purchase the new bottle rather than the refill.

As is apparent from the foregoing, there exists a need in the art for a new bottle refill and a method of distributing the refill with the bottle. The present invention addresses this particular need, as will be discussed in more detail below.

BRIEF DESCRIPTION OF THE DRAWINGS

These and other features and advantages of the various embodiments disclosed herein will be better understood with respect to the following description and drawings in which like numbers refer to like parts throughout and in which.

DETAILED DESCRIPTION OF THE INVENTION

Figure 2:
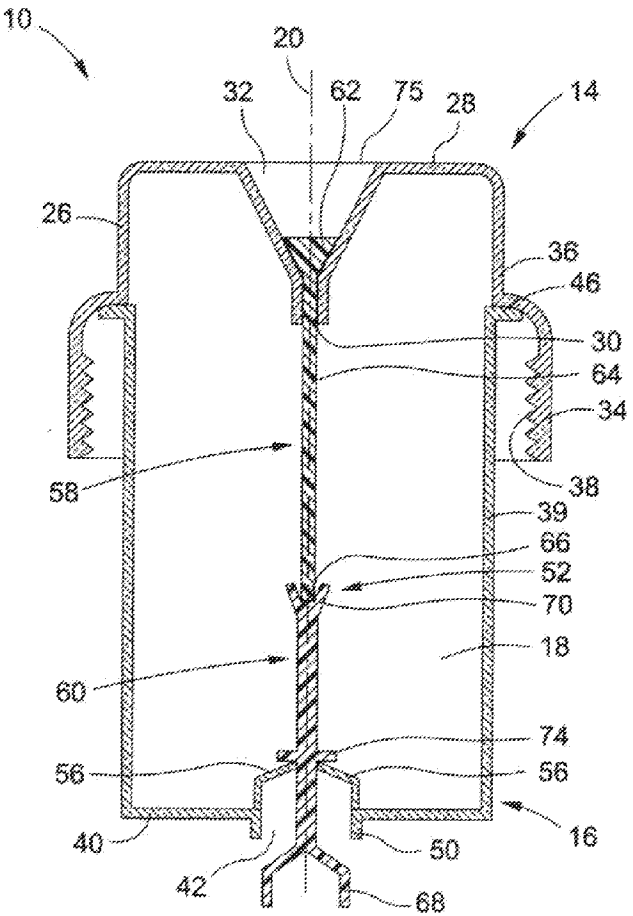
FIG. 2 is a side sectional view of the refill cap shown in an actuated configuration to release the concentrate from the internal reservoir.

Referring now to the drawings wherein the showings are for purposes of illustrating a preferred embodiment of the present invention only, and not for purposes of limiting the same, FIGS. 1-5 illustrate a refill cap 10 constructed in accordance with a first embodiment of the present invention. The refill cap 10 may be engaged with a bottle 12 (see FIGS. 3-5) having a chemical agent, such as cleaning fluids, detergents, cosmetic fluids, perfumes, or other fluids known in the art, disposed within the bottle 12. It is contemplated that the refill cap 10 may serve as a conventional cap or closing mechanism to close an opening on the bottle 12. The refill cap 10 gives consumers a "two for one" purchase, since the refill cap 10 may be used to facilitate the refill of the bottle 12 in a manner which will be described in more detail below. The easy-to-use configuration of the refill cap 10 allows for simple refilling of the bottle 12, thereby extending the usage of the bottle 12, which provides environmental and economic advantages.

The bottle 12 includes a bottle wall 13 (see FIGS. 4 and 5) that is preferably formed out of a substantially fluid impermeable material, such as plastic, rubber, or other materials known in the art. The bottle wall 13 defines a reservoir 15 configured to receive a fluid, such as a cleaning fluid, or other fluids. It is contemplated that the size and shape of the bottle 12 may vary without departing from the spirit and scope of the present invention.

Figure 1:
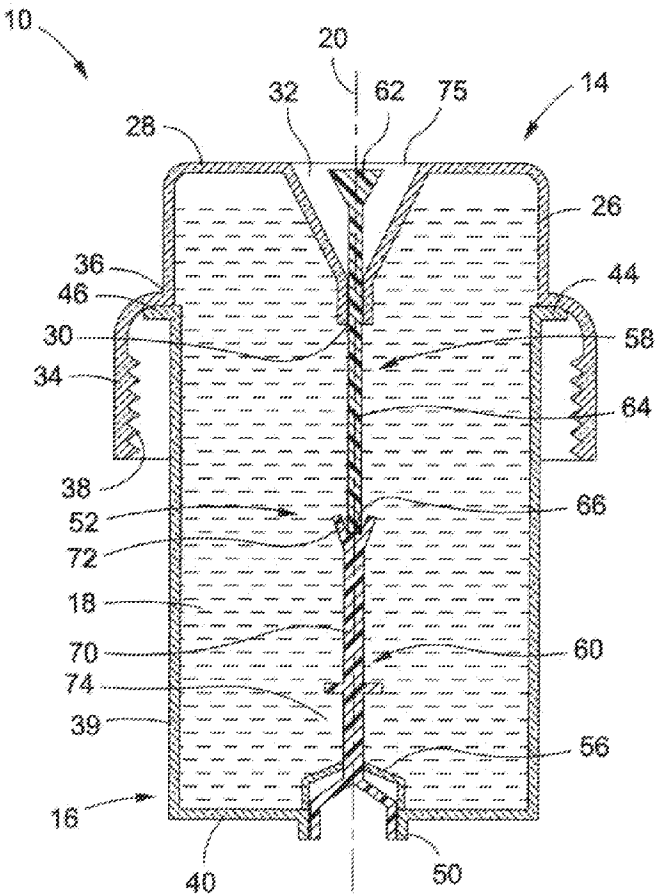
FIG. 1 is a side sectional view of a refill cap including an internal reservoir filled with concentrate.
Figure 3C:
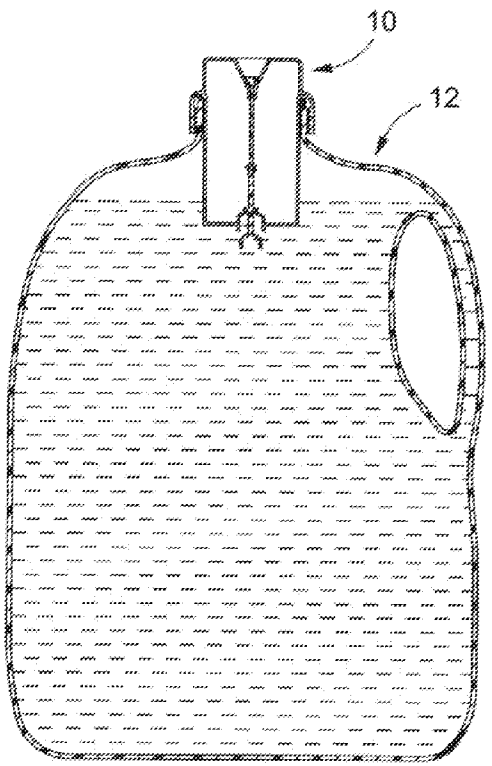
FIG. 3C is a side sectional view of the refill cap with the concentrate emptied therefrom and mixed with the diluting agent to refill the bottle.
Figure 3B:
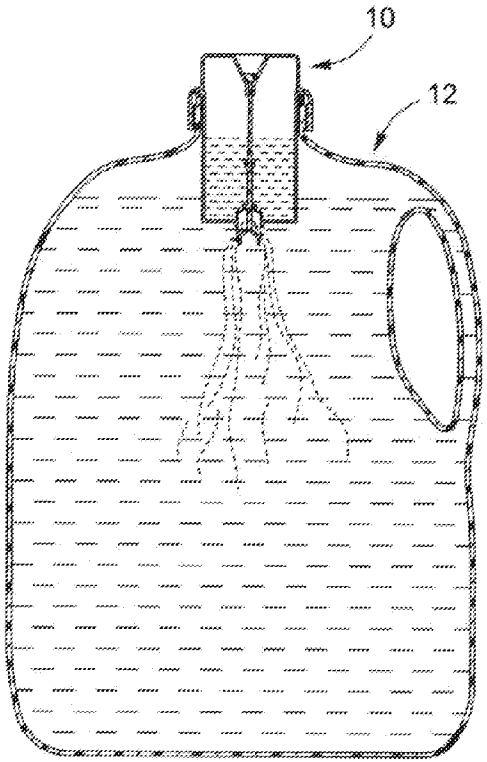
FIG. 3B is a side sectional view of the refill cap with concentrate being emptied into the bottle, wherein the bottle is filled with a diluting agent, such as water.
Figure 3A:
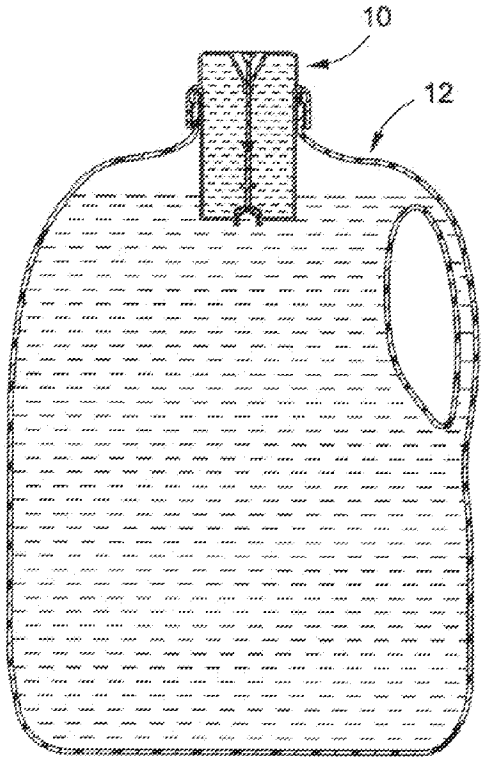
FIG. 3A is a side sectional view of the refill cap filled with concentrate, wherein the refill cap is engaged with a bottle filled with a chemical agent.
Figure 5:
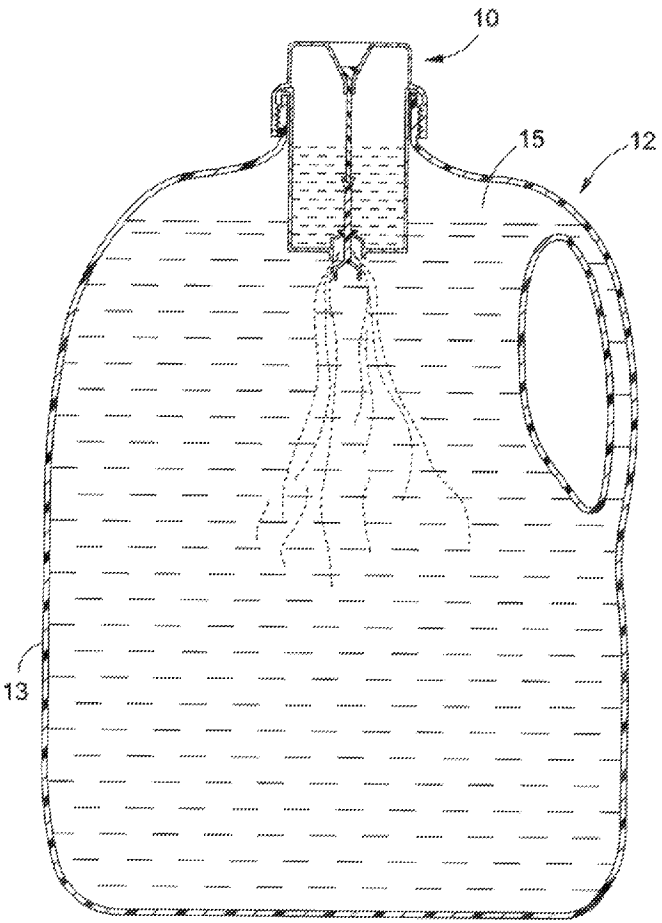
FIG. 5 is an enlarged side sectional view of FIG. 3B.
Figure 4:
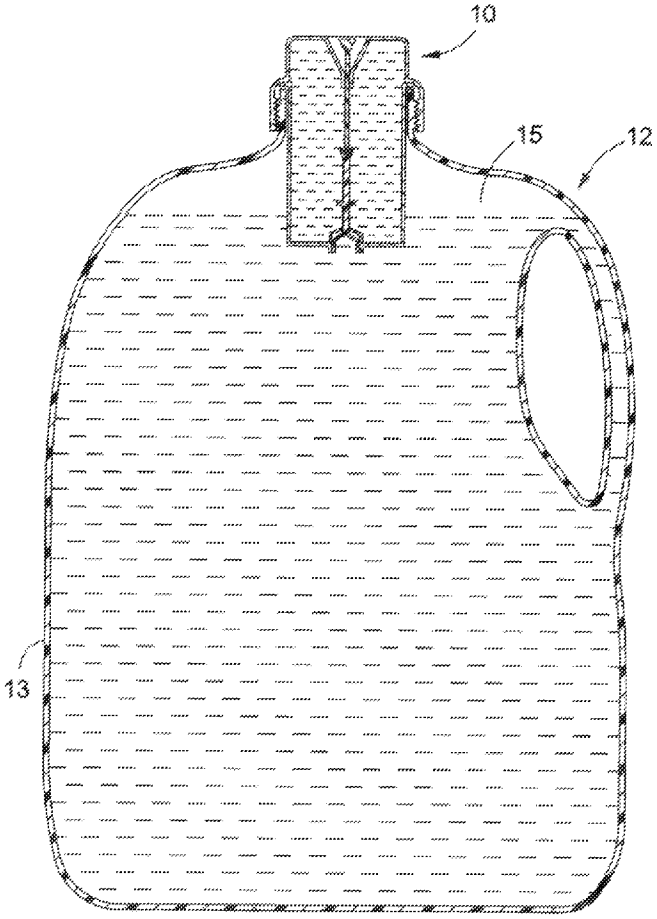
FIG. 4 is an enlarged side sectional view of FIG. 3A.

Referring now specifically to FIGS. 1-2, the refill cap 10 includes an upper body 14 and a lower body 16 collectively defining an internal reservoir 18 configured to store fluid. In this manner, the upper body 14 and lower body 16 are preferably formed of a fluid impermeable material, such as plastic or rubber. As depicted, the internal reservoir 18 is substantially cylindrical in shape and extends along a longitudinal reservoir axis 20. In this manner, a portion of the refill cap 10, particularly the lower body 16, is sized and configured to extend into the bottle 12 (see FIGS. 3-5), as described in more detail below. Those skilled in the art will appreciate that the refill cap 10 may include an internal reservoir 18 defining other non-cylindrical shapes and configurations.

The upper body 14 includes an upper cylindrical wall 26 and upper end wall 28 collectively defining a closed end portion of the upper body 14. The upper end wall 28 includes a planar portion extending from the upper cylindrical wall 26 radially toward the longitudinal reservoir axis 20 and a conical portion extending from the planar portion into the reservoir 18, wherein the conical portion defines an opening 30 in fluid communication with the reservoir 18. The conical portion defines an external notch 32 sized to receive a plug head, as will be described in more detail below.

The upper body 14 additionally includes a flared portion 34 connected to and extending from the upper cylindrical wall 26 to define an upper shoulder 36. The flared portion 34 defines a collar which is sized and configured to be disposed over the opening in the bottle 12 to engage with the bottle 12. Internal threads 38 are formed on the flared portion 34 to cooperatively engage with external threads formed on the bottle 12.

The lower body 16 includes a lower cylindrical wall 39 and a lower end wall 40 disposed about the axis 20, wherein the lower cylindrical wall 39 is complimentary in size and shape to the upper cylindrical wall 26 of the upper body 14. The lower body 16 further defines a lower opening 42 (see FIG. 2) extending through the lower end wall 40. The lower body 16 additionally includes a flange 44 extending about and protruding radially relative to the lower cylindrical wall 39 to define a lower shoulder 46. The flange 44 is configured to frictionally engage with the inner surface of the upper shoulder 36 to create a fluid tight seal between the upper body 14 and lower body 16 so as to maintain fluid within the reservoir 18. As can be seen in the Figures, the flared portion 34 is spaced from the lower body 16 by a prescribed gap.

The lower body 16 of the refill cap 10 also includes a ring-like projection 50 which protrudes from the lower end wall 40 and defines the lower opening 42. The projection 50 has an outer diameter that is smaller than the maximum outer diameter of the lower body 16. As will also be described in more detail below, a plug 52 may be inserted into the lower opening 42 (as shown in FIG. 1) to selectively mitigate fluid flow through the lower opening 42.

As best seen in FIGS. 1 and 2, the lower body 16 further includes a plurality of support arms 56, i.e., retention bracket, which are formed on the interior surface of the lower end wall 40 and project or protrude into the interior of the reservoir 18. More particularly, the support arms 56 are preferably arranged about the axis 20 and are formed such that the end portion of each support arm 56 disposed furthest from the lower end wall 40 is angled toward the axis 20. Further, each of the support arms 56, in addition to being integrally connected to the lower end wall 40, preferably has a relatively thin profile. The use of the support arm 56 will also be described in more detail below.

Referring now to FIG. 1, there is shown a plug 52 that is cooperatively engaged to the upper body 14 and the lower body 16. The plug 52 includes an upper plug portion 58 and a lower plug portion 60. The upper plug portion 58 includes an upper plug head 62 and an upper plug shaft 64 coupled to the upper plug head 62, wherein the upper plug shaft 64 terminates to define a distal tip 66. The upper plug shaft 64 is configured to be inserted and advanced through the opening 30 to extend into the reservoir 18. The upper plug head 62 is sized and configured to define a size that is larger than the opening 30 to mitigate passage of the upper plug head 62 through the opening 30. Along these lines, the upper plug head 62 is configured to be engagable with the external surface of the conical section of the upper end wall 28 to create a fluid tight seal therebetween to mitigate fluid flow through the opening 30 upon engagement between the upper plug head 62 and the upper end wall 28. In this regard, the upper plug head 62 preferably defines a shape which is complimentary to the conical section of the upper end wall 28.

The lower plug portion 60 includes a flared end portion 68, a lower shaft portion 70 and a v-shaped end portion 72, with the flared end portion 68 and v-shaped end portion 72 being formed on opposing ends of the lower shaft portion 70. The flared portion 68 also has a generally circular cross-sectional configuration, and an outer diameter which exceeds that of the lower shaft portion 70. The lower plug portion 60 also includes a plug flange 74, i.e., a retention plate, which circumscribes the lower shaft portion 70 and protrudes radially outward therefrom. As seen in FIGS. 1 and 2, the plug flange 74 is disposed in closer proximity to the flared end portion 68 than to the v-shaped end portion 72. The use of the plug flange 74 will also be described in more detail below.

In order to fill the reservoir 18 with the concentrate, the lower body 16 is attached to the upper body 14. The upper plug portion 58 may be inserted into the upper body 14 before or after engagement with the lower body 16. The upper/lower body assembly is then flipped upside down (relative to the orientation shown in FIG. 1), to allow concentrate to be inserted into the reservoir 18 through lower opening 42. When the reservoir 18 is filled with concentrate, the lower plug portion 60 is inserted through the lower opening 42. The v-shaped end portion 72 of the lower plug portion 60 is configured to facilitate mating with the distal tip 66 of the upper plug portion 58. Therefore, the lower plug portion 60 is inserted through the lower opening 42 to mate the lower plug portion 60 with the upper plug portion 58, and is further advanced to bring the flared end portion 68 into engagement with the projection 50 to create a fluid tight seal therebetween.

In the cap 10, the plug 52 is cooperatively engageable to both the lower body 16 and the cap 50, and is selectively moveable between a sealing position (shown in FIG. 1) and a dispensing position (shown in FIG. 2) relative thereto. In this regard, when the plug 52 is in the sealing position relative to the remainder of the cap 10, the flared end portion 68 of the plug 52 is operatively seated within and placed in sealed engagement to the projection 50 of the lower body 16. More particularly, when the plug 52 is in its sealing position, that end of the plug 52 defined by the flared end portion 68 is substantially flush or continuous with the distal rim defined by the projection 50. When the flared end portion 68 is in this particular position relative to the lower body 16, the outer surface of the flared end portion 68 is frictionally engaged to the inner surface of the projection 50 in a manner facilitating the creation of a fluid tight-seal therebetween. Due to the fluid-tight seal created between the flared end portion 68 and the projection 50, any fluid filled into the reservoir 18 of the cap 10 is effectively maintained therein when the plug 52 is in its sealing position. Further, the plug flange 74 is spaced from the distal ends of the support arms 56.

As indicated above, the plug 52 is moveable relative to the upper body 14 and the lower body 16 from its sealing position shown in FIG. 1, to a dispensing position shown in FIG. 2. The movement of the plug 52 from its sealing position to its dispensing position is facilitated by the application of downward pressure by an external object (such as one finger of a consumer) to the upper plug head 62 of the plug 52. As the plug 52 is moved from the sealing position toward the dispensing position, the flared end portion 68 is moved downwardly along the axis 48 (when viewed from the perspective shown in FIG. 1) from within and thus out of fluid-tight engagement with the projection 50. Such downward movement of the upper plug body 14 is terminated or limited by the abutment of the upper plug head 62 against the upper end wall 28. Furthermore, such downward movement of the lower plug body 16 is terminated or limited by the abutment of the plug flange 74 against the distal ends of the support arms 56. Importantly, when the upper plug head 62 assumes this particular orientation relative to the upper end wall 28, a fluid tight seal is preferably created therebetween to mitigate fluid loss through the opening 30. A resilient membrane 75 may be connected to the upper body 14 and extend over the notch 32 to create a fluid tight seal between the upper body 14 and the resilient membrane 75 to provide an additional fluid seal in the event fluid leaks through opening 30. The resilient membrane 75 may have enough resiliency to enable a user to push the upper plug head 62 from the sealing position to the dispensing position.

As will be recognized, the movement of the flared end portion 68 from within and out of sealed engagement to the projection 50 of the lower body 16 effectively unblocks the opening 46 as allows for the flow of a fluid or liquid from within the interior of the reservoir 18 through the opening 46.

An exemplary use of the refill cap 10, when sold with and stored in the new bottle 12, is as follows. When the fluid level in the bottle 12 is sufficiently low, the cap 10 is removed from the bottle 12 to provide access to the bottle reservoir 15. In most cases, the fluid within the refill cap 10 contains a highly concentrated level of the fluid that was previously in the bottle 12. Thereafter, water or other diluting fluid may be filled into the bottle reservoir 15 prior to dispensing the fluid within the refill cap 10 into the bottle 12. Typically, if the fluid within the refill cap 10 is filled into the bottle 12 prior to filling a diluting fluid in the bottle 12, the concentrated fluid emptied into the bottle 12 will begin to bubble as the diluting fluid is filled into the bottle 12. Therefore, it may be desirable to fill the diluting fluid into the bottle 12 prior to filling the concentrated fluid from the refill cap 10 into the bottle 12. To this end, the bottle 12 may include a marking to indicate how much diluting fluid is required for use with the concentrated fluid.

After the diluting fluid is sufficiently filled within the bottle 12, the cap 10 is engaged onto the bottle 12. The concentrated fluid within the refill cap 10 may then be dispensed into the bottle 12. To dispense the fluid within the refill cap 10, the upper plug head 62 is pushed by a user from the sealing position toward the dispensing position. More specifically, the upper plug head 62 is pushed by a user toward the opening 30 for engagement with the upper end wall 28. In this regard, the fluid tight seal between the flared end portion 68 and the projection 50 is broken in the above-described manner, thereby allowing the fluid within the refill cap 10 to exit the internal reservoir 18 via the second opening 42 and into the bottle 12. The user may then shake the bottle 12 to mix the highly concentrated fluid with the diluting fluid.

It is contemplated that the refill cap 10 possessing the above-described structural and functional attributes will be sold with the bottle 12 in the arrangement shown in FIG. 1, i.e., the refill cap 10 will be disposed on the bottle 12 at the point of sale. Advantageously, due to the configuration of the refill cap 10, the same may be maintained in its sealing position and the concentrated chemical agent maintained in the reservoir 18 during initial usage of the bottle 12. As previously explained, the movement of the plug 52 from its sealing position to its dispensing position is facilitated solely by the application of pressure thereto by an external object such as the finger of the consumer. In this regard, the structure of the refill cap 10 is not suited to causing the concentrated chemical agent stored in the reservoir 18 to be dispensed from therein as a result of the attachment of the cap 10 to the bottle 12. This represents a departure from prior art devices wherein the refill cartridge cannot be sold with the bottle.

It is also contemplated that the refill cap 10 may be sold separate from the bottle 12. In other words, a user may purchase the refill cap 10 to refill the bottle 12 when the fluid within the bottle 12 is empty. It is also contemplated that the refill cap 10 may be sold with the bottle 12 without being stored inside the bottle 12. However, as indicated above, the most common contemplated usage of the refill cap 10 is for it to be sold with and stored inside a new bottle 12, with the bottle 12 already being filled with a fluid for dispensing by the pumping mechanism 22. In this instance, when the fluid level within the bottle 12 decreases to the point where bottle 12 is effectively empty, the fluid or concentrated chemical agent within the on-board refill cap 10 may be used to refill the bottle 12.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A refill cap comprising:

a body including:

a cylindrical wall;

an end wall extending from the cylindrical wall, the end wall and the cylindrical wall defining an internal reservoir; and a first and a second opening which each communicate with the internal reservoir;

a tubular projection extending from the end wall and defining the second opening which fluidly communicates with the internal reservoir;

a plug including separate first and second plug portions which are cooperatively engaged to each other, the plug being selectively moveable relative to the body between a sealing position and a dispensing position;

a retention bracket extending from the end wall into the internal reservoir; and a retention plate coupled to the second plug portion;

the pine being configured such that the second plug portion is frictionally engaged to the tubular projection of the body to effectively block the second when the plug is in the sealing position, the application of pressure on the plug facilitating movement from the sealing position to the dispensing position, with the movement of the plug to the dispensing position facilitating the formation of a fluid flow path between the tubular projection and the second plug portion;

the retention plate being spaced from the retention bracket when the plug is in the sealing position and the retention plate being engaged with the retention bracket when the plug is moved to the dispensing position.

2. The refill cap recited in claim 1, wherein the second plug portion defines a v-shaped notch configured to be engageable with the first plug portion.

3. The refill cap recited in claim 1, wherein the second plug portion defines a flared end portion configured to be advanced into the second opening and frictionally engagable with the body when the plug is in the sealing position.

4. The refill cap recited in claim 1, wherein the body includes a first body and a second body engageable with the first body to collectively define the internal reservoir.

5. The refill cap recited in claim 4, wherein the first body includes:

a closed end portion defining a portion of the internal reservoir; and a flared end portion extending, from the closed end portion and defining an increasing diameter in a direction extending away from the closed end portion, such that flared end portion is spaced from the second body by a prescribed gap.

6. The refill cap recited in claim 4, wherein the first body includes a first body end wall including a planar portion and a conical portion extending from the planar portion into the internal reservoir.

7. The refill cap recited in claim 3, wherein the first plug portion defines:

a plug head defining a shape thin is complimentary to the conical portion of the first body end wall; and a plug shaft connected to the plug head;

the plug head being spaced from the conical portion when the plug is in the sealing position and the plug head being moved toward the conical portion when the plan is moved from the sealing position toward the dispensing position.

8. A refill cap comprising:

to body defining an internal reservoir and having first and second openings each in communication with the internal reservoir, the both extending into the internal reservoir to define a recess with the first opening residing in the recess, the body including a tubular projection defining the second opening which fluidly communicates with the reservoir;

a plug having a plug first and second end portions, the plug being selectively moveable relative to the body between a sealing position and as dispensing position, the plug first end portion being advanced into the recess as the plug is moved from the sealing position toward the dispensing position and the plug second end portion is frictionally engaged to the tubular projection of the body to effectively block the second opening when the plug is in the sealing position, the application of pressure in the plug facilitating movement from the sealing position to the dispensing position, with the movement of the plug to the dispensing position facilitating the formation of a fluid flow path between the tubular projection and the second plug portion;

a retention bracket coupled to the body; and a retention plate coupled to the plug second cud portion, the retention plate being spaced from the retention bracket when the plug is in the sealing position and engaged with the retention bracket when the plug is moved to the dispensing position.

9. The refill cap recited in claim 8, wherein the plug firs end portion is received within the recess and engaged with the body wall when the plug is in the dispensing position.

10. The refill cap recited in claim 8, wherein the plug first end portion is complimentary in shape to the portion of the body defining the recess such that when the plug is in the dispensing position, the plug first end portion is configured to be nested within the recess.

11. The refill cap recited in claim 8, wherein the plug second end portion defines a flared end portion configured to be advanced into the second opening to sealingly engage the body when the plug is in the sealing position.

12. The refill cap recited in claim 8, wherein the body includes a first body and a second body engageable with the first body to collectively define the internal reservoir.

13. The refill cap recited in claim 12, wherein the first body includes:

a closed end portion defining a portion of the internal reservoir; and a flared end portion extending from the closed end portion and defining an increasing diameter in a direction extending away from the closed end portion such that the flared end portion is spaced from the first body by a prescribed gap and is internally threaded.

14. The refill cap recited in claim 8, wherein the plug includes separate first and second plug portions engagable with each other.

15. The refill cap recited in claim 14, wherein the first plug portion defines a plug head complimentary in shape to the recess and a plug shaft.

16. The refill cap recited in claim 14, wherein the second plug portion defines a v-shaped notch configured to be engageable with the first plug portion.

17. The refill cap recited in claim 14, wherein the second plug portion defines a flared end portion configured to be advanced into the second opening to effectively block the second opening when the plug is in the sealing position.

* * * * *